US011643926B2

(12) United States Patent
Adams et al.

(10) Patent No.: US 11,643,926 B2
(45) Date of Patent: May 9, 2023

(54) WELL BARRIER SENSOR DATA STORAGE AND RETRIEVAL

(71) Applicant: WEATHERFORD TECHNOLOGY HOLDINGS, LLC, Houston, TX (US)

(72) Inventors: Keith Adams, Aberdeen (GB); Jon Humphrey, Aberdeen (GB)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 119 days.

(21) Appl. No.: 17/126,599

(22) Filed: Dec. 18, 2020

(65) Prior Publication Data

US 2022/0195869 A1 Jun. 23, 2022

(51) Int. Cl.
*E21B 47/26* (2012.01)
*E21B 33/12* (2006.01)
*E21B 34/06* (2006.01)

(52) U.S. Cl.
CPC ..... *E21B 47/26* (2020.05); *E21B 33/12* (2013.01); *E21B 34/06* (2013.01); *E21B 2200/05* (2020.05)

(58) Field of Classification Search
CPC ..... E21B 47/26; E21B 33/12; E21B 34/06; E21B 2200/05; E21B 47/06; E21B 47/138
See application file for complete search history.

(56) References Cited

U.S. PATENT DOCUMENTS 5,448,227 A * 9/1995 Orban ..... E21B 47/16 340/855.8
7,397,388 B2 * 7/2008 Huang ..... E21B 47/20 340/854.3
2002/0043369 A1 * 4/2002 Vinegar ..... E21B 43/122 166/250.07
2004/0154390 A1 * 8/2004 Baustad ..... E21B 47/135 73/152.55
2008/0128128 A1 * 6/2008 Vail ..... E21B 4/18 166/241.1
2012/0241218 A1 * 9/2012 Chau ..... E21B 47/017 175/325.1

(Continued)

FOREIGN PATENT DOCUMENTS

WO 2020/131991 A1 6/2020

OTHER PUBLICATIONS

International Search Report with Written Opinion dated Jan. 28, 2022 for PCT Patent Application No. PCT/US2021/047835, 14 pages.

(Continued)

*Primary Examiner* — Steven A MacDonald
(74) *Attorney, Agent, or Firm* — Smith IP Services, P.C.

(57) ABSTRACT

A well tool assembly can include a well barrier and a detachable sub connected to the well barrier. The detachable sub can include a sensor data receiver. A method of retrieving sensor data can include positioning a sensor on one side of a well barrier, connecting a detachable sub on an opposite side of the well barrier, the detachable sub including a sensor data receiver configured to receive sensor data from the sensor, and conveying the well barrier, the sensor and the detachable sub together into a well. A system can include a sensor, a detachable sub, and a well barrier positioned between the sensor and the detachable sub, the detachable sub including a sensor data receiver, a passage extending longitudinally through the detachable sub, and a closure that selectively opens and blocks the passage.

23 Claims, 7 Drawing Sheets

(56) References Cited

U.S. PATENT DOCUMENTS

| | | | | |
|---|---|---|---|---|
| 2012/0292023 | A1* | 11/2012 | Hinkie | E21B 47/12 166/66 |
| 2015/0204155 | A1* | 7/2015 | Patel | E21B 47/13 166/360 |
| 2015/0330211 | A1* | 11/2015 | Kabatek | E21B 23/08 166/250.01 |
| 2018/0179886 | A1* | 6/2018 | Espe | E21B 47/002 |
| 2020/0080415 | A1* | 3/2020 | Behjat | E21B 33/14 |
| 2020/0370415 | A1* | 11/2020 | Das | E21B 47/017 |
| 2022/0056779 | A1* | 2/2022 | Aviles | E21B 47/06 |

OTHER PUBLICATIONS

Acoustic Data Ltd.; "SonicGuage Real-time Wireless Monitoring System", overview datasheets via www.acousticdata.com, dated 2019, 4 pages.

Acoustic Data Ltd.; "SonicGuage Wireless Monitoring System", datasheets via www.acousticdata.com, dated Jul. 2018, 3 pages.

Weatherford; Petroline Slickplug Slickline-Set Retrievable Bridge Plug, company brochure 226.02, dated 2005-2007, 8 pages.

Interwell; "Product Sheet: Down-Hole Sensing GS (DSGS) Pulling Tool", Rev. 1.0 via www.interwell.com, dated Mar. 6, 2015, 2 pages.

* cited by examiner

WELL BARRIER SENSOR DATA STORAGE AND RETRIEVAL

BACKGROUND

This disclosure relates generally to equipment utilized and operations performed in conjunction with a subterranean well and, in examples described below, more particularly provides for storage and retrieval of sensor data proximate a well barrier.

A well barrier may be used in a subterranean well to isolate sections of the well from each other. In such a situation, an uphole section of the well may be accessible from the surface, but a downhole section may not be accessible due to the well barrier set in the well. Thus, it can be difficult to obtain data from a sensor positioned in the downhole section.

It will, therefore, be readily appreciated that improvements are continually needed in the art of designing, constructing and utilizing sensor data collection systems for use in a subterranean well. Such improvements may be useful with a wide variety of different well configurations, sensor positions and sensor types.

DETAILED DESCRIPTION

Figure 1:
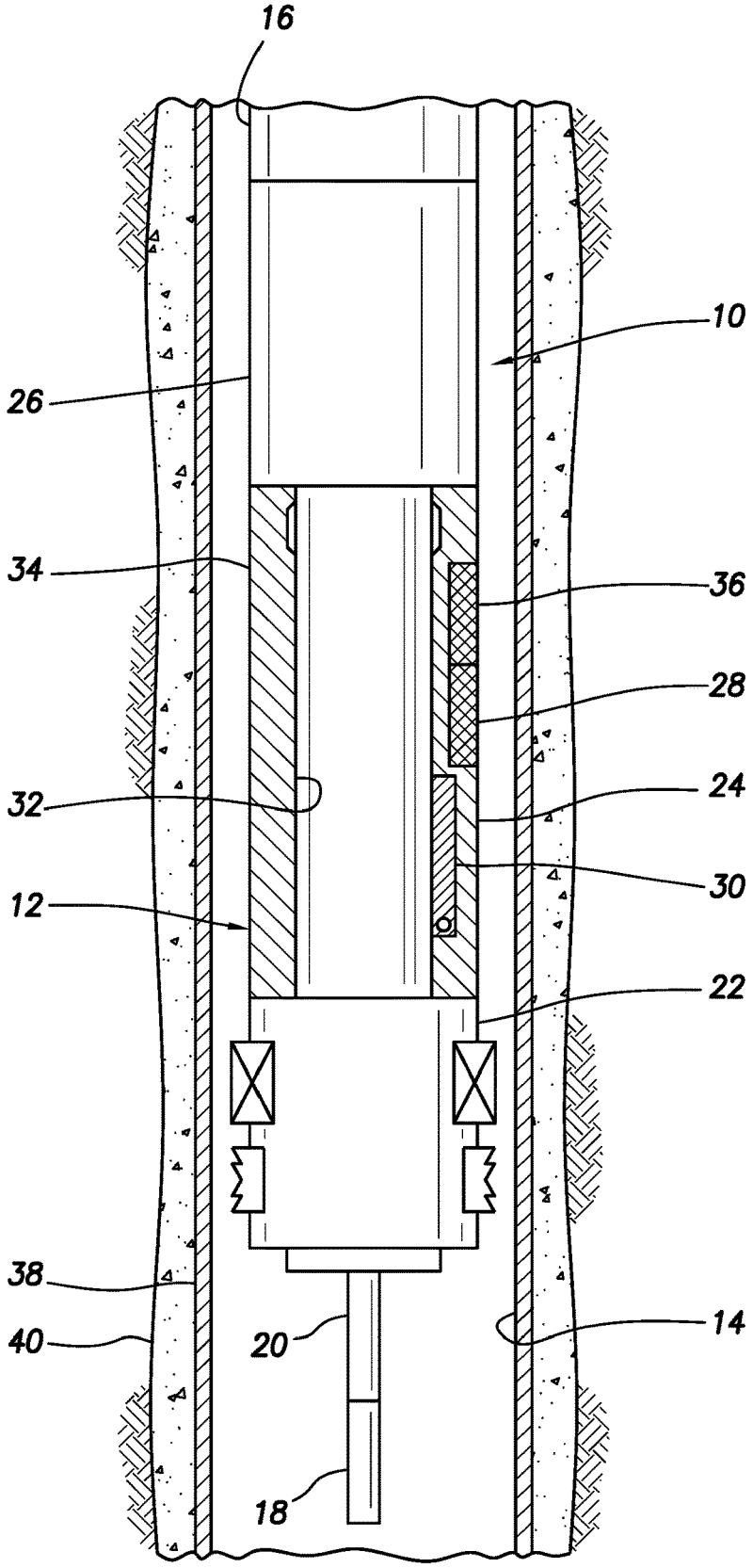
FIG. 1 is a representative partially cross-sectional view of an example of a system and associated method which can embody principles of this disclosure, in which a well barrier is being conveyed into a well.

Representatively illustrated in FIG. 1 is a system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a well tool assembly 12 is conveyed into a wellbore 14 by a conveyance 16. The conveyance 16 could comprise a tubular string (such as, a continuous or segmented tubing string), a wireline, a slickline, a tractor, or any other form of conveyance.

The wellbore 14 is lined with casing 38 and cement 40, and the wellbore is generally vertical as depicted in FIG. 1. However, in other examples the well tool assembly 12 could be used in an uncased or open hole portion of an inclined or generally horizontal wellbore. The scope of this disclosure is not limited to any particular details of the wellbore 14 or any other features of the well as depicted in FIG. 1.

The well tool assembly 12 in this example includes one or more sensors 18, a sensor data transmitter 20, a well barrier 22, a detachable sub 24 and a setting tool 26. The detachable sub 24 depicted in FIG. 1 is of the type known to those skilled in the art as a junk catcher, but other types of subs detachable from the well barrier 22 may be used in other examples. Additional well tools, different well tools, or different combinations of well tools may be used in other examples. The scope of this disclosure is not limited to use of any particular combination of well tools in a well tool assembly.

The sensors 18 in this example include a pressure sensor, a temperature sensor and a force sensor or load cell. Additional sensors, different sensors, or different combinations of sensors may be used in other examples. The scope of this disclosure is not limited to use of any particular sensor or combination of sensors.

The sensors 18 are connected to the sensor data transmitter 20. The sensor data transmitter 20 is capable of transmitting sensor data from the sensors 18 to a sensor data receiver 28 of the detachable sub 24. The sensor data transmitter 20 may include memory to store or buffer the sensor data prior to transmitting the sensor data to the sensor data receiver 28.

Note that the sensors 18 and the sensor data transmitter 20 are connected on a downhole side of the well barrier 22, and the sensor data receiver 28 is connected on an uphole side of the well barrier 22. In this example, the sensor data transmitter 20 communicates with the sensor data receiver 28 wirelessly, for example, using acoustic, radio wave, electromagnetic, inductive, Bluetooth™ or other wireless communication technique.

Although the sensors 18 and the sensor data transmitter 20 are depicted in FIG. 1 as extending downward from the well barrier 22, in other examples the sensors and the sensor data transmitter could be enclosed in a housing connected to the well barrier. Alternatively, the sensors 18 and the sensor data transmitter 20 could be integrated into the well barrier or a housing thereof.

The well barrier 22 in the FIG. 1 example comprises a bridge plug which, when set, completely isolates a downhole section of the wellbore 14 from an uphole section of the wellbore. In other examples, the well barrier 22 could be a packer that isolates a downhole annulus from an uphole annulus. The scope of this disclosure is not limited to use of any particular type of well barrier.

The detachable sub 24 in the FIG. 1 example is used to prevent accumulation of debris on the well barrier 22, which might otherwise prevent or hinder subsequent unsetting and retrieval of the well barrier from the wellbore 14. For this purpose, the detachable sub 24 comprises a closure 30 that selectively opens and blocks a passage 32 that extends longitudinally through a generally tubular outer housing 34 of the detachable sub.

As depicted in FIG. 1, the closure 30 is in the form of a flapper that is biased toward a closed position. When the setting tool 26 is positioned in the passage 32, the closure 30 is maintained in an open position (as shown in FIG. 1). When the setting tool 26 is retrieved from the passage 32 after setting the well barrier 22, the closure 30 is allowed to pivot to the closed position to block the passage. In other examples, the closure 30 could be in the form of a ball valve, a plug valve, a sliding panel, or any other type of closure.

In the FIG. 1 example, the detachable sub 24 also optionally includes one or more sensors 36 connected to the sensor data receiver 28. The sensors 36 may be similar to, or different from, the sensors 18. Sensor data may be transmitted from the sensors 36 to the sensor data receiver 28 using wired or wireless techniques.

The sensor data receiver 28 may include memory to store the sensor data received from the sensors 18 and/or the sensors 36. In some examples, the sensor data receiver 28 may also comprise a transmitter for transmitting the sensor data to another sensor data receiver positioned downhole, as described more fully below.

The setting tool 26 is used to set the well barrier 22 in the casing 38 in the FIG. 1 example. In other examples, the well barrier 22 could be set in an uncased section of the wellbore 14. Any type of setting tool may be used for setting the well barrier 22, including but not limited to conventional hydraulic, electric and pyrotechnic setting tools.

Figure 2:
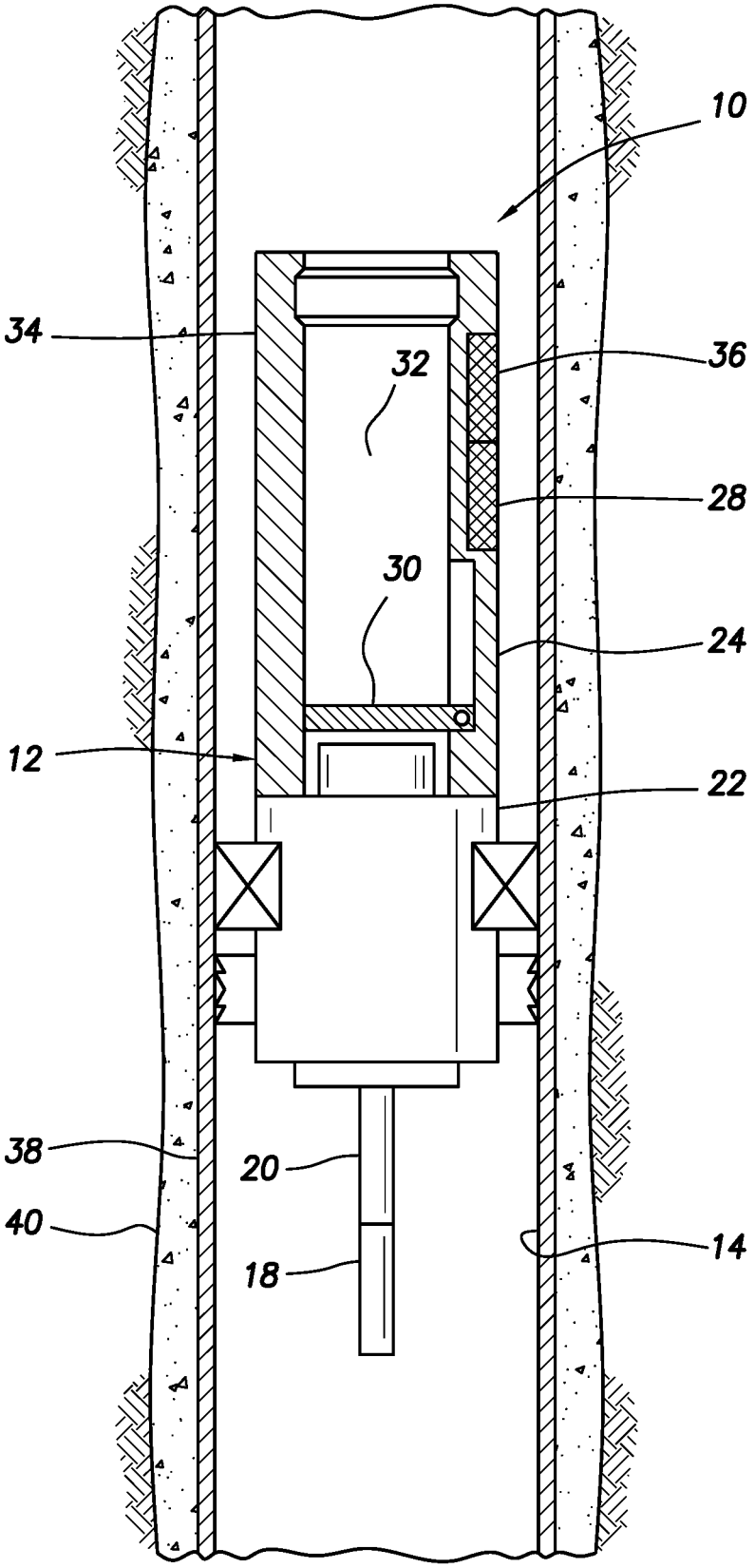
FIG. 2 is a representative partially cross-sectional view of the system and method, in which the well barrier is set in the well.

Referring additionally now to FIG. 2, the system 10 is representatively illustrated after the setting tool 26 (see FIG. 1) has been actuated to set the well barrier 22 in the well. The setting tool 26 has subsequently been released and retrieved from the well. When the setting tool 26 is withdrawn from the passage 32, the closure 30 pivots downward and thereby blocks the passage above the well barrier 22.

Setting the well barrier 22 causes it to grip and seal against the casing 38 in this example. If the well barrier 22 is instead set in an uncased section of the wellbore 14, the well barrier would grip and seal against an inner wall of the wellbore. In some examples, the well barrier 22 may not include separate gripping and sealing elements (for example, the well barrier could be in the form of an inflatable or a swellable packer, in which cases a seal element thereof could both grip and seal against a well surface and the setting tool 26 may not be used).

Figure 3:
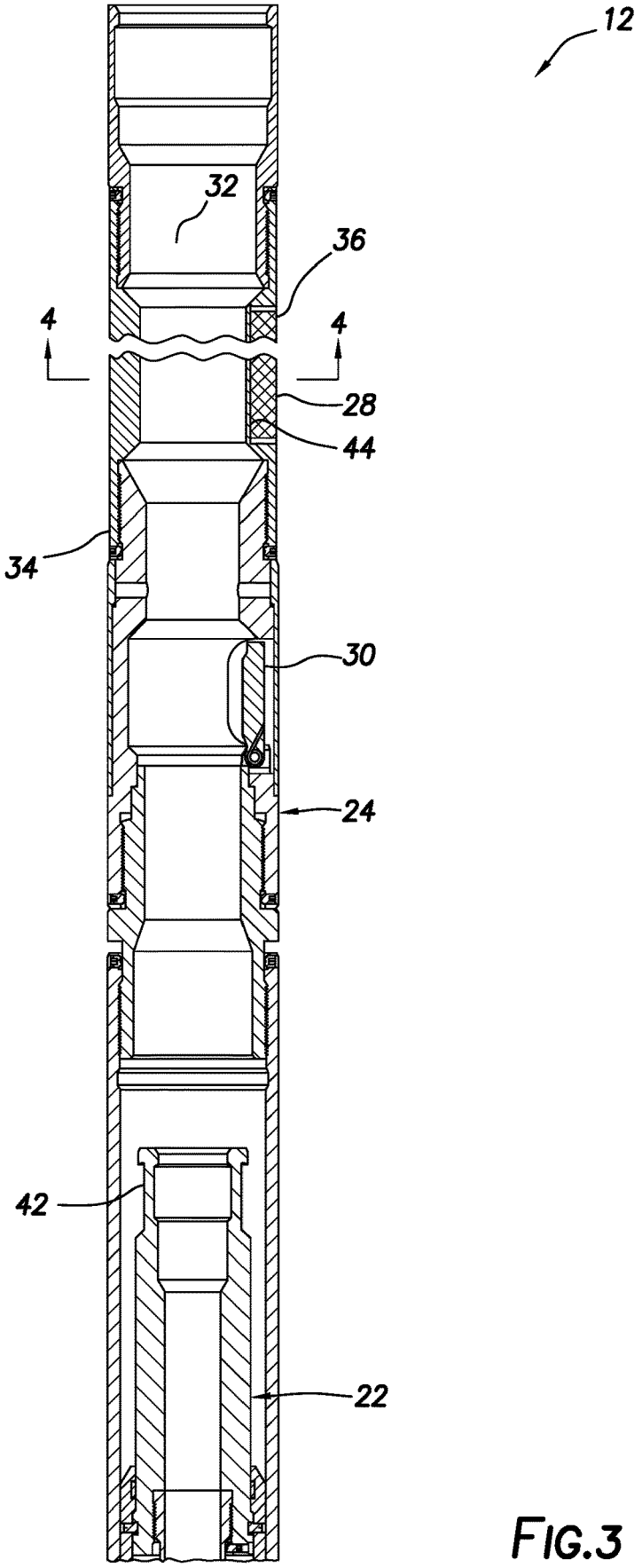
FIG. 3 is a representative cross-sectional view of an example of a junk catcher that may be used with the system and method.

Referring additionally now to FIG. 3, a more detailed cross-sectional view of an example of the detachable sub 24 is representatively illustrated. An upper fishing neck 42 of the well barrier 22 is also depicted in FIG. 3.

As depicted in FIG. 3, the setting tool 26 is not received in the passage 32, but the closure 30 is shown in its open position. In actual practice, when the setting tool 26 is withdrawn from the passage 32, the closure 30 will displace to its closed position blocking the passage.

In the FIG. 3 example, the sensor data receiver 28 and the sensors 36 are received in an external slot or recess 44 formed in the outer housing 34. Thus, the sensor data receiver 28 and the sensors 36 are not accessible via the passage 32. As described more fully below, in other examples the sensor data receiver 28 and the sensors 36 may be accessible and exposed to the passage 32.

The outer housing 34 in the FIG. 3 example includes multiple threaded together components. In other examples, any or all of these components may be combined, so that the outer housing 34 includes fewer components. The scope of this disclosure is not limited to any particular construction or configuration of the outer housing 34 or any other elements of the detachable sub 24.

Figure 4:
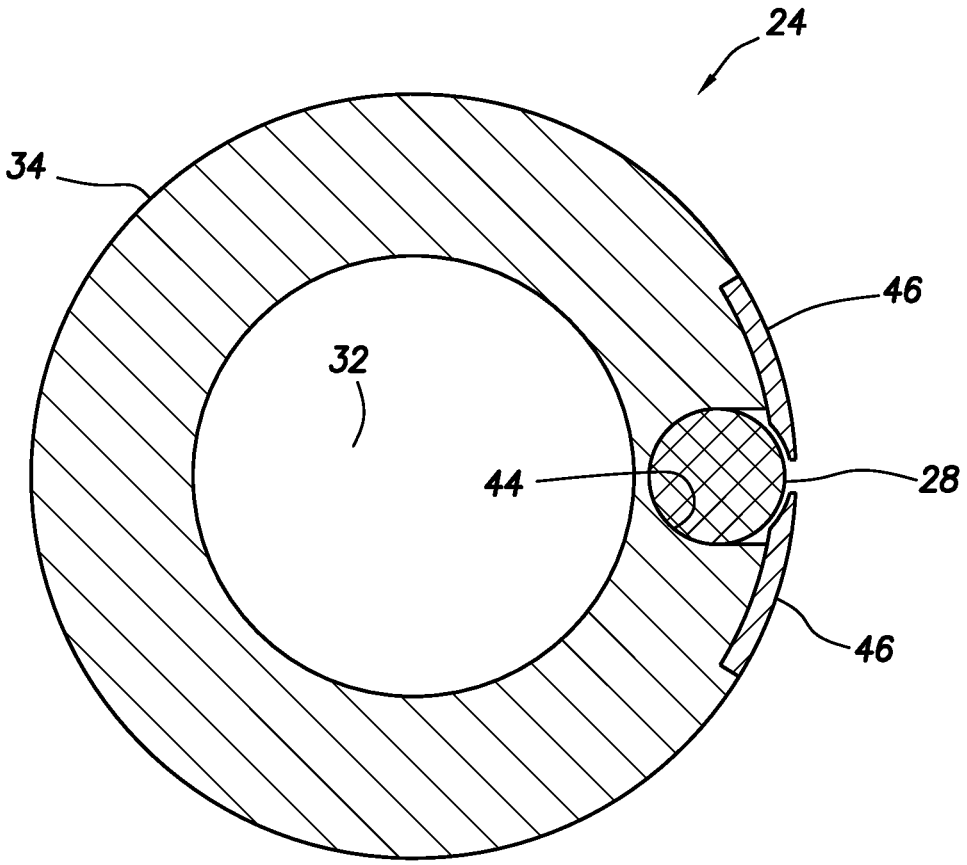
FIG. 4 is a representative cross-sectional view of the junk catcher, taken along line 4-4 of FIG. 3.

Referring additionally now to FIG. 4, a cross-sectional view of the detachable sub 24, taken along line 4-4 of FIG. 3, is representatively illustrated. In this view, a manner in which the sensor data receiver 28 and the sensors 36 can be retained in the external recess 44 is visible.

In this example, the external recess 44 is in the form of a U-shaped slot or groove formed in an exterior surface of the outer housing 34. Curved retainer plates 46 are shaped to conform to an outer diameter of the outer housing 34 and an outer diameter of the sensor data receiver 28 and the sensors 36. The retainer plates 46 may be secured to the outer housing 34 using conventional fasteners.

Figure 5:
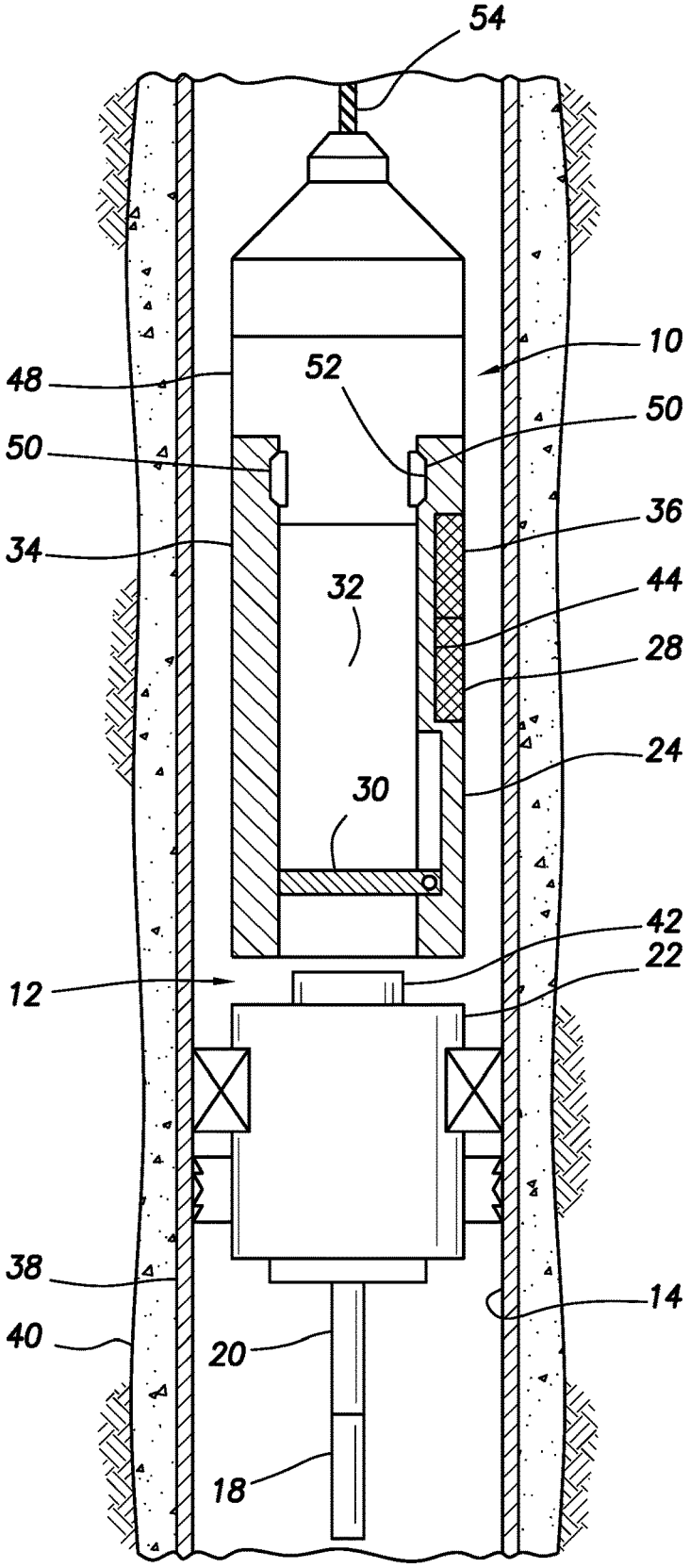
FIG. 5 is a representative partially cross-sectional view of the system and method, in which a junk catcher is being retrieved from the well.

Referring additionally now to FIG. 5, an example of a method of retrieving the sensor data from the well is representatively illustrated. In this example, a junk catcher retrieval tool 48 is conveyed into the well and is engaged with the junk catcher outer housing 34 (for example, by latch members 50 of the retrieval tool engaging an internal profile 52 formed in the outer housing).

The retrieval tool 48 may be conveyed into the well using a variety of different techniques. As depicted in FIG. 5, a wireline 54 serves as a conveyance to convey the retrieval tool 48 into the well and into engagement with the detachable sub 24. The wireline 54 may also be used to apply tension to the detachable sub 24, in order to release the detachable sub from the well barrier 22 (which remains set in the well). In other examples, slickline, tubing or other types of conveyances may be used, and the detachable sub 24 may be released from the well barrier 22 using any of a variety of different techniques (for example, including manipulation such as rotation of tubing engaged with the detachable sub, etc.).

After the detachable sub 24 is released from the well barrier 22, the detachable sub (with the sensor data receiver 28 and the sensors 36) can be retrieved to the surface. At the surface, the sensor data can be obtained from the sensor data receiver 28, for example, by downloading the sensor data from the sensor data receiver, removing the memory from the sensor data receiver, wirelessly transmitting the sensor data from the sensor data receiver, etc. The scope of this disclosure is not limited to any particular technique for obtaining the sensor data from the sensor data receiver 28.

If desired, the detachable sub 24 (optionally including the sensor data receiver 28 and the sensors 36) may be re-installed in the well after the sensor data has been obtained from the sensor data receiver at the surface. The retrieval tool 48 may be used for this purpose, or another installation tool may be used.

Figure 6:
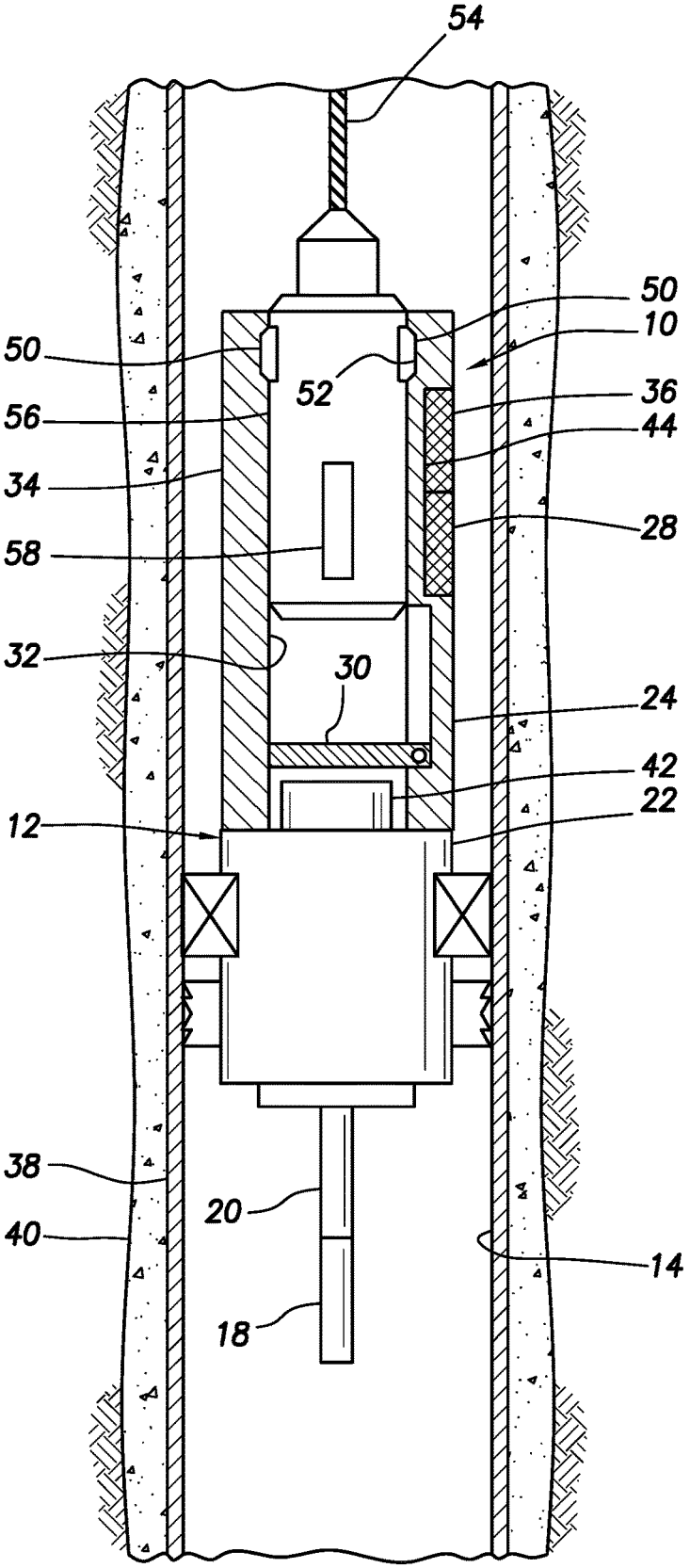
FIG. 6 is a representative partially cross-sectional view of another example of the system and method, in which a sensor data retrieval tool is being used to retrieve sensor data.

Referring additionally now to FIG. 6, another example method of obtaining the sensor data from the well is representatively illustrated. In this example, a sensor data retrieval tool 56 is conveyed at least partially into the passage 32 (such as, using the wireline 54 or another conveyance 16, etc.) and engaged with the detachable sub 24.

The sensor data retrieval tool 56 in this example includes a sensor data receiver 58. The sensor data receiver 58 may be similar to, or different from, the sensor data receiver 28. In the FIG. 6 example, the sensor data receiver 28 can also include a transmitter (e.g., similar to the sensor data transmitter 20 of FIG. 1 to transmit the sensor data to the sensor data receiver 58).

Preferably, the sensor data receivers 28, 58 are configured to communicate with each other wirelessly, but in some examples a wired connection could be made between the sensor data receivers when the retrieval tool 56 is appropriately positioned in the passage 32. Thus, the scope of this disclosure is not limited to any particular technique for transmitting the sensor data from the sensor data receiver 28 to the sensor data receiver 58.

After the sensor data has been received by the sensor data receiver 58, the retrieval tool 56 can be disengaged from the detachable sub 24 and retrieved to the surface. The sensor data can then be obtained from the sensor data receiver 58 at the surface, such as, using the techniques described above for obtaining the sensor data from the sensor data receiver 28 in the FIG. 5 example.

Figure 7:
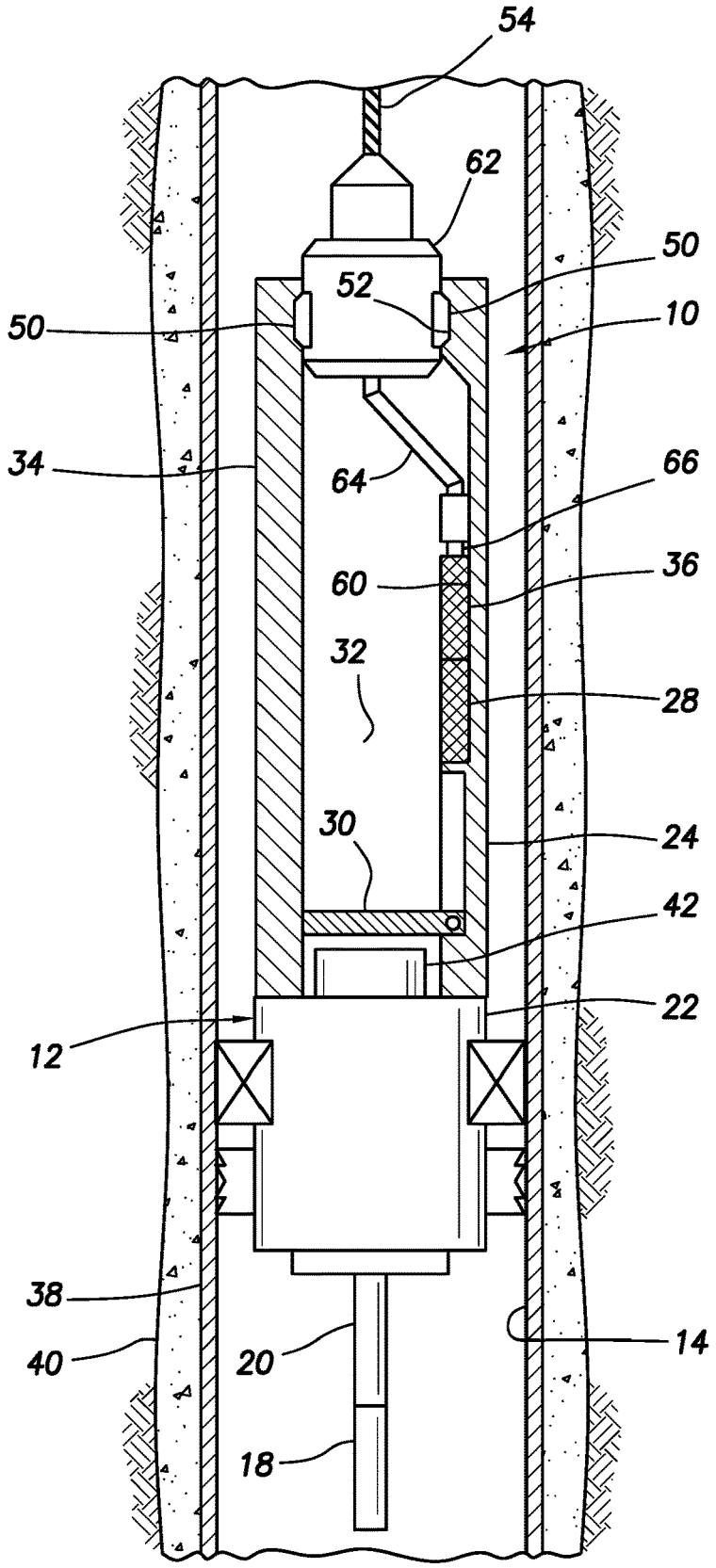
FIG. 7 is a representative partially cross-sectional view of another example of the system and method, in which a receiver retrieval tool is being used to retrieve a sensor data receiver.

Referring additionally now to FIG. 7, another example method of obtaining the sensor data from the well is representatively illustrated. In this example, the sensor data receiver 28 and the sensors 36 are received in an internal slot or recess 60 formed in the outer housing 34. Thus, the sensor data receiver 28 and the sensors 36 are exposed to and accessible via the passage 32.

As depicted in FIG. 7, a receiver retrieval tool 62 is conveyed into the well (for example, using the wireline 54 or other conveyance 16, etc.) and engaged with the detachable sub 24. The receiver retrieval tool 62 is at least partially received in the passage 32 in this example.

A retrieval arm 64 of the receiver retrieval tool 62 is configured to engage the sensor data receiver 28 and the sensors 36, in order to remove these components from the internal recess 60. For example, the retrieval arm 64 could be configured similar to a conventional retrieval tool used with side pocket mandrels of the type well known to those skilled in the art. In such an example, the retrieval arm 64 could latch onto a fishing neck 66 at an upper end of the sensor data receiver 28 and the sensors 36.

Note that it is not necessary in this example for the sensors 36 to be retrieved from the detachable sub 24 with the sensor data receiver 28. It may be desirable for the sensors 36 to remain in the detachable sub 24 when the sensor data receiver 28 is retrieved to the surface (or in some examples the sensors 36 may not be used at all).

After the sensor data receiver 28 and the sensors 36 have been secured to the retrieval arm 64, the retrieval tool 62 (with the sensor data receiver 28 and optionally the sensors 36) can be retrieved to the surface. At the surface, the sensor data can be obtained from the sensor data receiver 28 using wired or wireless techniques as described above.

If desired, the sensor data receiver 28 and optionally the sensors 36 may be re-installed in the well after the sensor data has been obtained from the sensor data receiver at the surface. The retrieval tool 62 may be used for this purpose, or another installation tool may be used.

It may now be fully appreciated that the above disclosure provides significant advancements to the art of designing, constructing and utilizing sensor data collection systems for use in a subterranean well. In examples described above, sensor data from the sensors 18 can be obtained, even though the sensors 18 are positioned on a downhole side of a well barrier 22 set in the well.

Examples of a well tool assembly 12 for use in a subterranean well are described above. The well tool assembly 12 can comprise a well barrier 22, and a detachable sub 24 connected to the well barrier 22. The detachable sub 24 can comprise a sensor data receiver 28.

The sensor data receiver 28 may be configured to receive sensor data transmitted from a first sensor 18 positioned on a first side of the well barrier 22. The detachable sub 24 may be positioned on a second side of the well barrier 22 opposite the first side.

The sensor data receiver 28 may be configured to receive sensor data from a second sensor 36 positioned on the second side of the well barrier 22.

The detachable sub 24 may comprise a passage 32 extending longitudinally through the detachable sub 24. A closure 30 may be configured to selectively open and block the passage 32.

The well tool assembly 12 may include a sensor data retrieval tool 56 releasably positioned in the passage 32. The sensor data retrieval tool 56 may be configured to receive sensor data from the sensor data receiver 28.

The well tool assembly 12 may include a receiver retrieval tool 62 releasably positioned in the passage 32. The receiver retrieval tool 62 may be configured to retrieve the sensor data receiver 28 from the detachable sub 24.

The detachable sub 24 and the sensor data receiver 28 may be releasable from the well barrier 22 in the well.

Examples of a method of retrieving sensor data from a subterranean well are also described above. The method can comprise: positioning a first sensor 18 on a first side of a well barrier 22; connecting a detachable sub 24 on a second side of the well barrier 22 opposite the first side, the detachable sub 24 comprising a sensor data receiver 28 configured to receive sensor data from the first sensor 18; and conveying the well barrier 22, the first sensor 18 and the detachable sub 24 together into the subterranean well (i.e., in a single trip into the well).

The method may include setting the well barrier 22, and then closing a closure 30 of the detachable sub 24, thereby blocking a passage 32 extending longitudinally through the detachable sub 24.

The method may include positioning the sensor data receiver 28 in an internal recess 60 of the detachable sub 24, so that the sensor data receiver 28 is thereby accessible from the passage 32.

The method may include conveying a receiver retrieval tool 62 at least partially into the passage 32, and retrieving the sensor data receiver 28 from the detachable sub 24 in the well.

The method may include conveying a sensor data retrieval tool 56 at least partially into the passage 32, and transmitting the sensor data from the sensor data receiver 28 to the sensor data retrieval tool 56.

The method may include setting the well barrier 22 in the well, transmitting the sensor data from the first sensor 18 to the sensor data receiver 28, releasing the detachable sub 24 from the well barrier 22, and then retrieving the detachable sub 24 from the well.

The method may include positioning the sensor data receiver 28 in an external recess 44 of the detachable sub 24.

The detachable sub 24 may include a second sensor 36, and the sensor data receiver 28 may be configured to receive sensor data from the second sensor 36.

Examples of a system 10 for use with a subterranean well are also described above. The system 10 can comprise: a first sensor 18; a detachable sub 24 comprising a sensor data receiver 28, a passage 32 extending longitudinally through the detachable sub 24, and a closure 30 that selectively opens and blocks the passage 32; and a well barrier 22 positioned between the first sensor 18 and the detachable sub 24.

The sensor data receiver 28 may be configured to receive sensor data from the first sensor 18. The sensor data receiver 28 may be configured to receive sensor data from a second sensor 36 of the detachable sub 24.

The system 10 may include a sensor data retrieval tool 56 releasably positioned in the passage 32. The sensor data retrieval tool 56 may be configured to receive sensor data from the sensor data receiver 28.

The system 10 may include a receiver retrieval tool 62 releasably positioned in the passage 32. The receiver retrieval tool 62 may be configured to retrieve the sensor data receiver 28 from the detachable sub 24.

The detachable sub 24 and sensor data receiver 28 may be releasable from the well barrier 22 in the well.

The sensor data receiver 28 may be positioned in an internal recess 60 of the detachable sub 24. The sensor data receiver 28 may be positioned in an external recess 44 of the detachable sub 24.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well tool assembly for use in a subterranean well, the well tool assembly comprising:

a well barrier; and a detachable sub connected to the well barrier, in which a first end of the detachable sub is configured to be selectively attached to and detached from a conveyance while the detachable sub is positioned in the well, in which a second end of the detachable sub opposite the first end is configured to be selectively detached from and reattached to the well barrier while the well barrier isolates an uphole section of the well from a downhole section of the well, and in which the detachable sub comprises a sensor data receiver which is configured to store received data.

2. The well tool assembly of claim 1, in which the sensor data receiver is configured to receive sensor data transmitted from a first sensor positioned on a first side of the well barrier, and the detachable sub being positioned on a second side of the well barrier opposite the first side.

3. The well tool assembly of claim 2, in which the sensor data receiver is configured to receive sensor data from a second sensor positioned on the second side of the well barrier.

4. The well tool assembly of claim 1, in which the detachable sub comprises a passage extending longitudinally through the detachable sub, and a closure configured to selectively open and block the passage.

5. The well tool assembly of claim 4, further comprising a sensor data retrieval tool releasably positioned in the passage, the sensor data retrieval tool being configured to receive sensor data from the sensor data receiver.

6. The well tool assembly of claim 4, further comprising a receiver retrieval tool releasably positioned in the passage, the receiver retrieval tool being configured to retrieve the sensor data receiver from the detachable sub.

7. The well tool assembly of claim 1, in which the detachable sub and the sensor data receiver are releasable from the well barrier in the well.

8. A method of retrieving sensor data from a subterranean well, the method comprising:

positioning a first sensor on a first side of a well barrier;

connecting a detachable sub on a second side of the well barrier opposite the first side, in which a first end of the detachable sub is configured to be selectively attached to and detached from a conveyance while the detachable sub is positioned in the well, in which a second end of the detachable sub opposite the first end is configured to be selectively detached from and reattached to the well barrier while the well barrier isolates an uphole section of the well from a downhole section of the well, and in which the detachable sub comprises a sensor data receiver configured to receive and store sensor data from the first sensor; and conveying the well barrier, the first sensor and the detachable sub together into the subterranean well.

9. The method of claim 8, further comprising setting the well barrier, and then closing a closure of the detachable sub, thereby blocking a passage extending longitudinally through the detachable sub.

10. The method of claim 9, further comprising positioning the sensor data receiver in an internal recess of the detachable sub, the sensor data receiver being thereby accessible from the passage.

11. The method of claim 9, further comprising conveying a receiver retrieval tool at least partially into the passage, and retrieving the sensor data receiver from the detachable sub in the well.

12. The method of claim 9, further comprising conveying a sensor data retrieval tool at least partially into the passage, and transmitting the sensor data from the sensor data receiver to the sensor data retrieval tool.

13. The method of claim 8, further comprising setting the well barrier in the well, transmitting the sensor data from the first sensor to the sensor data receiver, releasing the detachable sub from the well barrier, and then retrieving the detachable sub from the well.

14. The method of claim 8, further comprising positioning the sensor data receiver in an external recess of the detachable sub.

15. The method of claim 8, in which the detachable sub further comprises a second sensor, and the sensor data receiver is configured to receive sensor data from the second sensor.

16. A system for use with a subterranean well, the system comprising:

a first sensor;

a detachable sub comprising a sensor data receiver, a passage extending longitudinally through the detachable sub, and a closure that selectively opens and blocks the passage; and a well barrier positioned between the first sensor and the detachable sub, in which a first end of the detachable sub is configured to be selectively attached to and detached from a conveyance while the detachable sub is positioned in the well, and in which a second end of the detachable sub opposite the first end is configured to be selectively detached from and reattached to the well barrier while the well barrier isolates an uphole section of the well from a downhole section of the well.

17. The system of claim 16, in which the sensor data receiver is configured to receive sensor data from the first sensor.

18. The system of claim 16, in which the sensor data receiver is configured to receive sensor data from a second sensor of the detachable sub.

19. The system of claim 16, further comprising a sensor data retrieval tool releasably positioned in the passage, the sensor data retrieval tool being configured to receive sensor data from the sensor data receiver.

20. The system of claim 16, further comprising a receiver retrieval tool releasably positioned in the passage, the receiver retrieval tool being configured to retrieve the sensor data receiver from the detachable sub.

21. The system of claim 16, in which the detachable sub and sensor data receiver are releasable from the well barrier in the well.

22. The system of claim 16, in which the sensor data receiver is positioned in an internal recess of the detachable sub.

23. The system of claim 16, in which the sensor data receiver is positioned in an external recess of the detachable sub.

* * * * *